US007703252B2

(12) United States Patent
Randjelovic

(10) Patent No.: US 7,703,252 B2
(45) **Date of Patent: *Apr. 27, 2010**

(54) SUB-FLOOR ASSEMBLIES FOR SPORTS FLOORING SYSTEMS

(75) Inventor: Erlin A. Randjelovic, Crystal Falls, MI (US)

(73) Assignee: Connor Sport Court International, Inc., Salt Lake City, UT (US)

( * ) Notice: Subject to any disclaimer, the term of this patent is extended or adjusted under 35 U.S.C. 154(b) by 669 days.

This patent is subject to a terminal disclaimer.

(21) Appl. No.: 11/592,383

(22) Filed: Nov. 3, 2006

(65) Prior Publication Data

US 2008/0104915 A1 May 8, 2008

(51) Int. Cl.
*E04F 15/22* (2006.01)

(52) U.S. Cl. ..... 52/403.1; 52/480; 52/177

(58) Field of Classification Search ..... 52/480, 52/177, 403.1; 472/92, 94
See application file for complete search history.

(56) References Cited

U.S. PATENT DOCUMENTS

| | | | | | |
|---|---|---|---|---|---|
| 1,195,289 | A | * | 8/1916 | Stevens | 52/402 |
| 1,693,655 | A | * | 12/1928 | Murphy | 52/402 |
| 2,092,694 | A | | 9/1937 | Crooks | |
| 2,134,674 | A | * | 10/1938 | Sherman et al. | 52/376 |
| 2,742,121 | A | * | 4/1956 | Liskey, Jr. | 52/180 |
| 3,080,021 | A | * | 3/1963 | Muir | 52/460 |
| 3,518,800 | A | | 7/1970 | Tank | |
| 3,566,569 | A | | 3/1971 | Coke et al. | |
| 3,868,802 | A | * | 3/1975 | Schubach | 52/462 |
| 3,909,059 | A | * | 9/1975 | Benninger et al. | 296/184.1 |
| 4,481,747 | A | * | 11/1984 | Tengesdal et al. | 52/460 |
| 4,856,250 | A | | 8/1989 | Gronau et al. | |
| 4,879,857 | A | | 11/1989 | Peterson et al. | |
| 5,016,413 | A | | 5/1991 | Counihan | |
| 5,497,590 | A | * | 3/1996 | Counihan | 52/385 |
| 5,904,011 | A | * | 5/1999 | Biro | 52/177 |
| 6,073,409 | A | * | 6/2000 | Chambers | 52/403.1 |
| 6,122,873 | A | | 9/2000 | Randjelovic | |
| 6,170,212 | B1 | * | 1/2001 | Suchyna et al. | 52/480 |
| 7,127,857 | B2 | * | 10/2006 | Randjelovic | 52/403.1 |
| 7,181,889 | B2 | * | 2/2007 | Perkowski et al. | 52/177 |
| 7,288,310 | B2 | * | 10/2007 | Hardwick | 428/181 |
| 7,485,358 | B2 | * | 2/2009 | Benaets | 428/124 |
| 2002/0033000 | A1 | * | 3/2002 | Pantelides et al. | 52/745.05 |
| 2003/0172608 | A1 | * | 9/2003 | Chambers | 52/480 |
| 2004/0040242 | A1 | * | 3/2004 | Randjelovic | 52/403.1 |
| 2006/0096187 | A1 | * | 5/2006 | Perkowski et al. | 52/177 |
| 2006/0242916 | A1 | * | 11/2006 | Simko et al. | 52/177 |

* cited by examiner

*Primary Examiner*—Richard E Chilcot, Jr.
*Assistant Examiner*—Alp Akbasli
(74) *Attorney, Agent, or Firm*—Gary R. Jarosik

(57) ABSTRACT

A sub-floor assembly for a sports flooring system includes a plurality of sub-floor panel components each formed of a plastic material and each having a formed channel wherein the formed channels of the plurality of sub-floor panel components are linearly aligned. A first strip of anchoring material is disposed within the linearly aligned formed channels of the plurality of sub-floor panel components and is used to attach a plurality of flooring strips to the sub-floor panel components.

30 Claims, 11 Drawing Sheets

SUB-FLOOR ASSEMBLIES FOR SPORTS FLOORING SYSTEMS

TECHNICAL FIELD

The following generally relates to sub-floor assemblies suitable for applications in multiple use facilities and in the construction of sports flooring and, more particularly, relates to a sub-floor assembly including a molded synthetic material component.

BACKGROUND

Sports flooring systems offer various designs including rigid construction providing little or no resilience, as well as highly resilient shock absorbing cushioned floors. Sports flooring systems include the option of anchorage methods to attach to a supporting substrate, which is most commonly concrete. Many sports flooring system designs also float freely with no anchorage attachment to the supporting substrate.

Examples of anchored sports flooring systems that provide little or no resiliency are exemplified in designs disclosed in U.S. Pat. No. 3,518,800 to Tank et al. and U.S. Pat. No. 3,566,569 to Coke et al. The Tank patent discloses a construction method wherein a steel channel is anchored to the supporting substrate and specially manufactured metal clips are used to secure flooring boards to the steel channels. The Coke patent discloses a construction method wherein wooden nailing strips are anchored to the supporting substrate and flooring boards are attached to the nailing strips by stapling or nailing.

Designs disclosed in U.S. Pat. No. 5,369,710 to Peterson et al. and U.S. Pat. No. 5,369,710 to Randjelovic et al. demonstrate widely used floating sports flooring system construction. The designs disclosed in both of these patents include resilient components resting on a supporting substrate which in turn supports a wooden sub-floor and flooring surface.

Sub-floor panels are also known to be manufactured of moldable material such as plastic or polyethylene. The design of such panels includes tongue and groove edges formed to interlock panels into a monolithic surface, which serves to support a flooring surface. Flooring material such as tongue and groove flooring is directly attached to the interlocking panels by means of mechanical fasteners such as staples or cleats. The underside of such panels can include cavity spaces in which resilient pads such as those previously described in the Peterson and Randjelovic patents are placed.

Another sub-floor assembly design is disclosed in U.S. Pat. No. 5,016,413 to Counihan et al. which includes a wooden panel sub-floor supported with resilient components. The design illustrated in the Counihan patent includes arranged plywood sub-floor panels and a means to restrain the flooring system by incorporating steel channels attached to the supporting substrate. U.S. Pat. No. 4,856,250 to Gronau et al. and U.S. Pat. No. 6,122,873 et al. to Randjelovic further demonstrate designs incorporating various wooden sub-floor and resilient components. These three referenced patents illustrate various methods to provide flooring systems with stability by means of substrate attachment while also providing resilient components for wanted shock absorbency.

These referenced patents and designs, which are incorporated herein by reference in their entirety, are examples of the known range of sub-floor constructions available and in use in the sports floor industry.

SUMMARY

To provide numerous advantages over known designs such as those described in the background section, disclosed hereinafter is an advanced sports flooring system sub-floor assembly. More particularly, the hereinafter disclosed sports flooring sub-floor assembly provides a sub-floor having a molded or extruded synthetic sub-floor component for placement over a sound substrate which, in turn, provides a base for attachment and/or support of a flooring surface. Since mechanical fasteners are not well suited for attachment into molded or extruded synthetic components, especially under conditions of changing temperatures and when constant flexing is expected as is typically desired in resilient sports flooring systems, the hereinafter described sub-floor assembly may further strategically incorporate elongated wooden nailing sections integrated with the molded or extruded synthetic panels which, in turn, may include designated underside cavities especially used for placement and housing of resilient components.

As will be appreciated, since the subject sub-floor assembly incorporates the use of synthetic materials, which may include recycled plastic materials, it has, among others, the advantage of being environmentally friendly, e.g., it reduces the use of forestry materials. In addition, it will be understood that the subject sub-floor assembly has the advantage of providing design flexibility, e.g., the formed sub-floor sections can be provided with a wide range of cavity designs that, in turn, allow for strategic placement of resilient components.

While the foregoing generally describes the subject sub-floor assembly and various advantages achieved thereby, a better understanding of the objects, advantages, features, properties, and relationships of the invention will be obtained from the following detailed description and accompanying drawings which set forth illustrative embodiments which are indicative of the various ways in which the principles of the invention may be employed.

BRIEF DESCRIPTION OF THE DRAWINGS

For a better understanding of the invention reference may be had to preferred embodiments shown in the following drawings in which.

DETAILED DESCRIPTION

Figure 1:
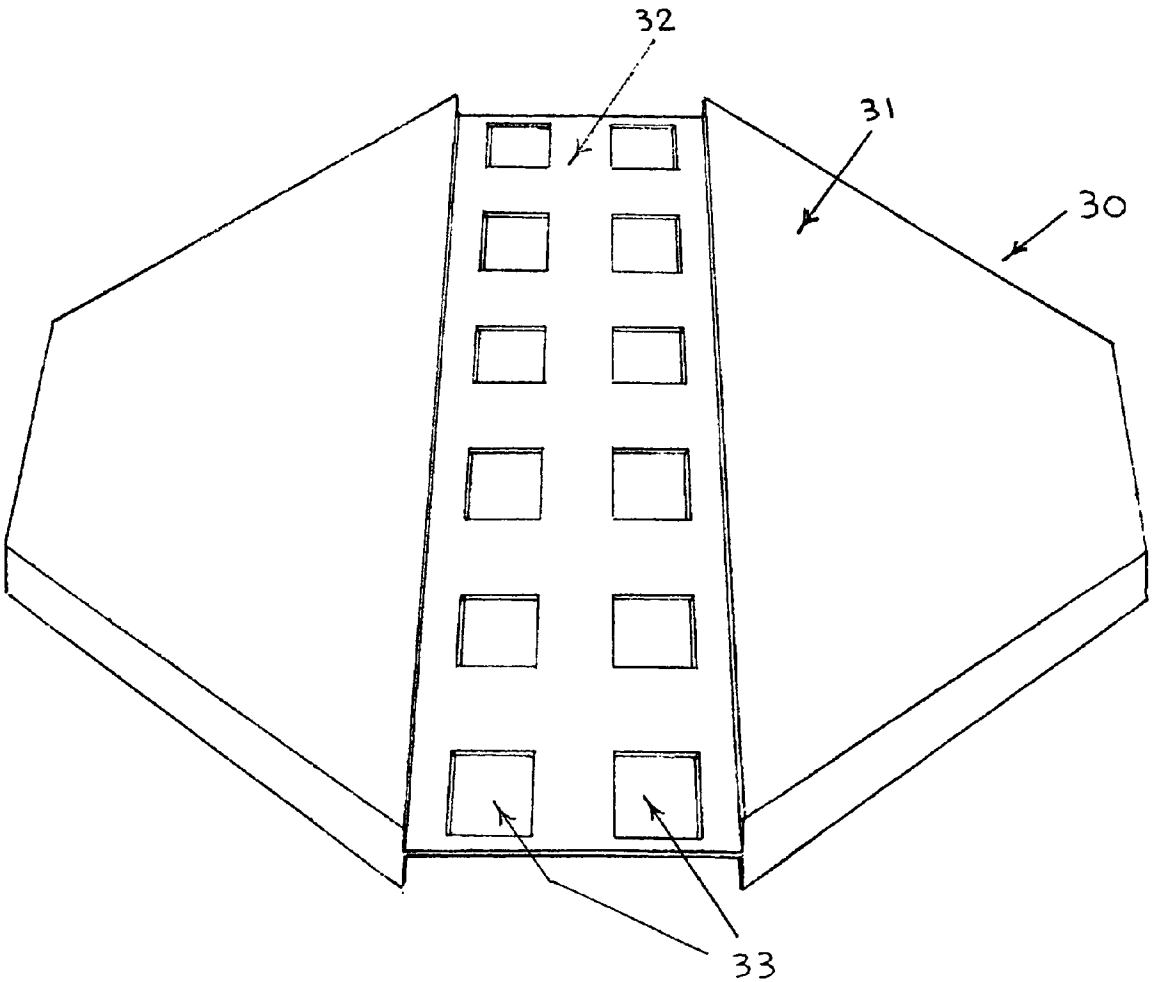
FIG. 1 is a perspective top view of a first exemplary molded sub-floor panel section made according to the present invention.

Preferred embodiments of the invention will be described in detail with reference to the figures, wherein like reference numerals represent like parts and assemblies throughout the several views.

In general, the present invention relates to a sub-floor for placement below an upper flooring surface generally used for athletic activities which together form a sports flooring.

Referring first to FIG. 1, which is a perspective view of a sub-floor panel 30 preferred to be composed of a suitable synthetic material, such as either recycled or new plastics commonly used when manufacturing molded components. While the sub-floor panel 30 is shown having a preferred octagon shape, it will be appreciated, as evidenced by FIG. 12, that the sub-floor panel can be provided in nearly limitless alternate shapes while remaining within the scope of the invention. The sub-floor panel 30 includes upper surface sections 31 and a center nailer plate 32 disposed intermediate the upper surface sections 31. Center nailer plates 32 are preferred to be manufactured in a thin dimension of 1/16" to 1/8" thickness and placed at a height below the upper surface sections 31 and at a height above the lower surfaces of the sub-floor panel 30 to thereby form opposed channels into which nailing sections are to be placed. The center nailer plate 32 may also include strategically placed voids 33 to allow for placement of an adhesive to assist in integration of nailing sections which will be described further in detail below.

Figure 2:
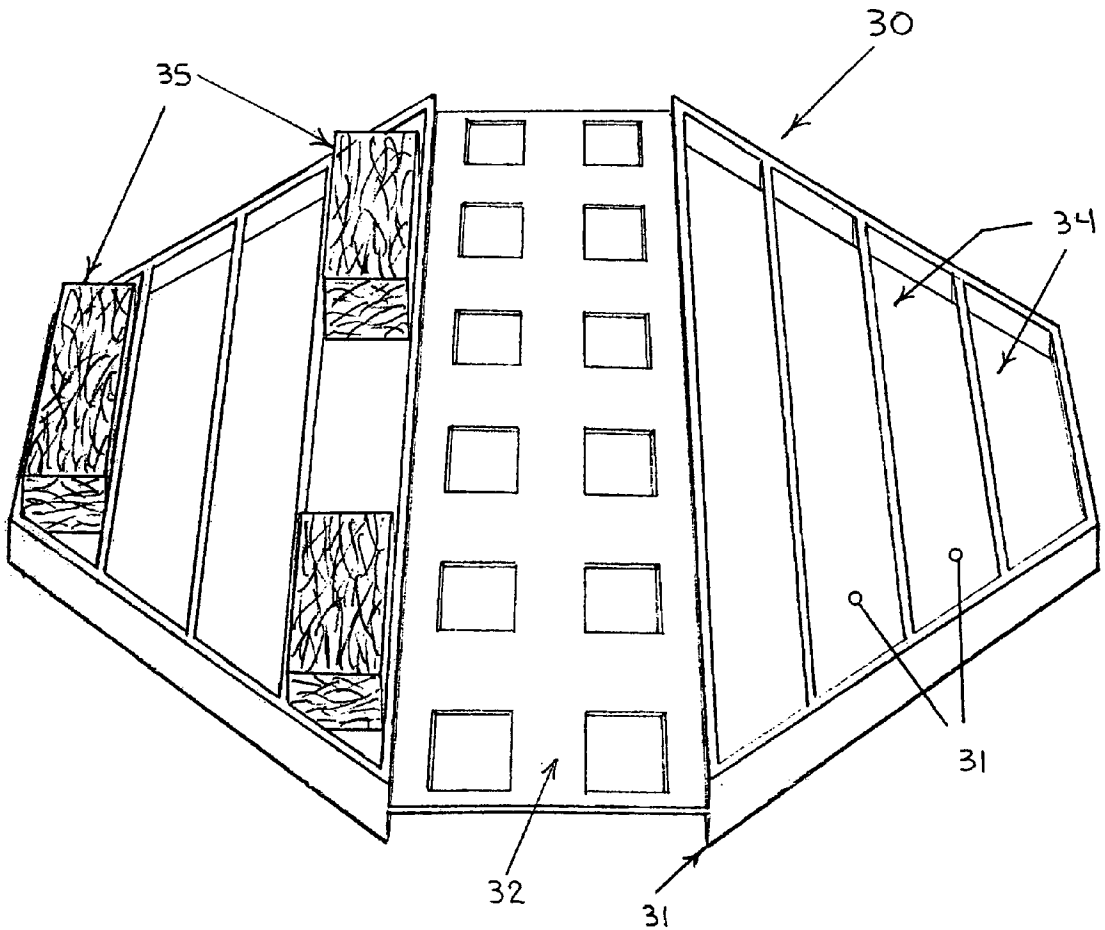
FIG. 2 is a perspective bottom view of the molded sub-floor panel section illustrated in FIG. 1.

FIG. 2 shows the underside of a sub-floor panel 30 and illustrates the inclusion of cavities 34 manufactured below the underside of upper surface sections 31. FIG. 2 also details positioning of the thin center nailer plate 32 in relation to upper surface sections 31 and lower surfaces of the sub-floor panel 30. While the cavities 34 are shown in a preferred alignment it is to be understood that the cavities 34 can be provided in alternate patterns that are nearly limitless. Cavities 34 allow housing of resilient pads 35 below the underside of the sub-floor panel 30. Resilient pads 35 are preferably manufactured of rubber, urethane, PVC, neo-prene or other materials that are commonly included in resilient sports floor construction.

Figure 3:
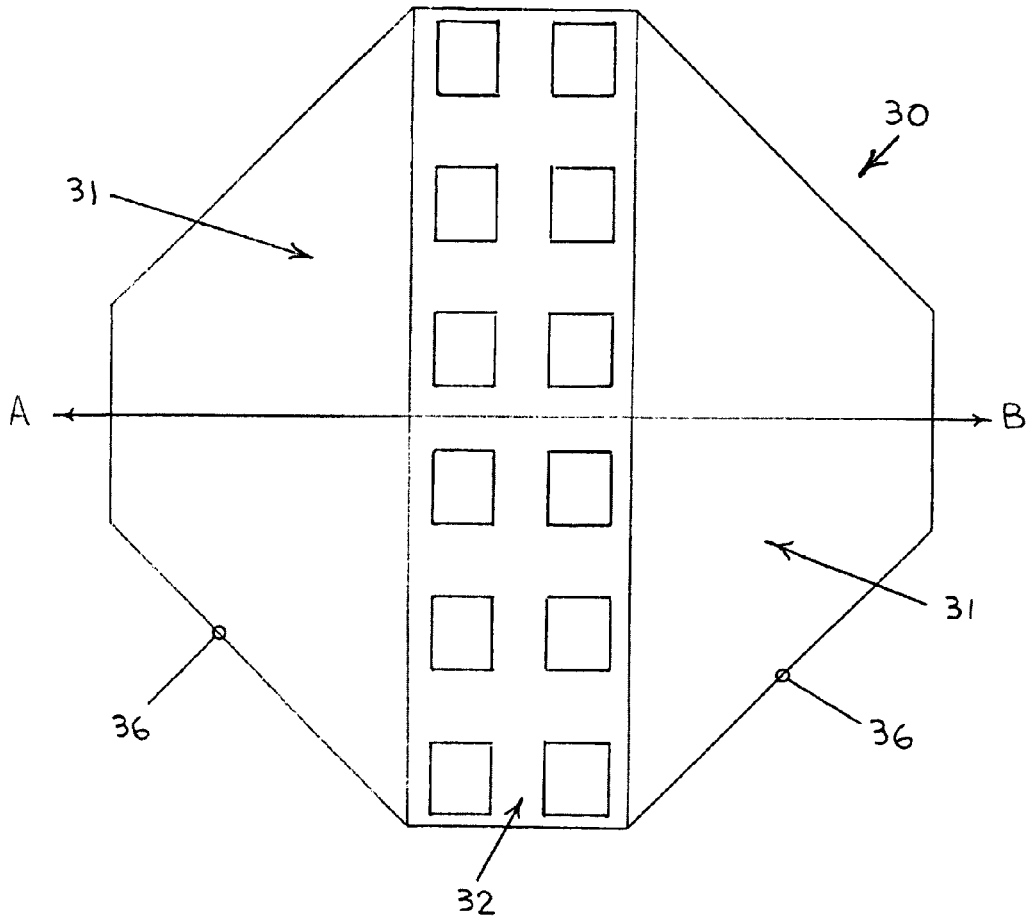
FIG. 3 is a top view of the molded sub-floor panel section illustrated in FIG. 1.

FIG. 3 is a top view of a sub-floor panel 30. In this illustrated example, the dimension of the center nailer plate 32 measures 4"×15" and the dimension across the sub-floor panel 30 is 15" when following the line as shown from A to B. Angled walls 36 of upper sub-floor sections 31 measure 8" in length and are aligned at 45 degree angles to the elongated edges of the center nailer plate 32.

Figure 4:
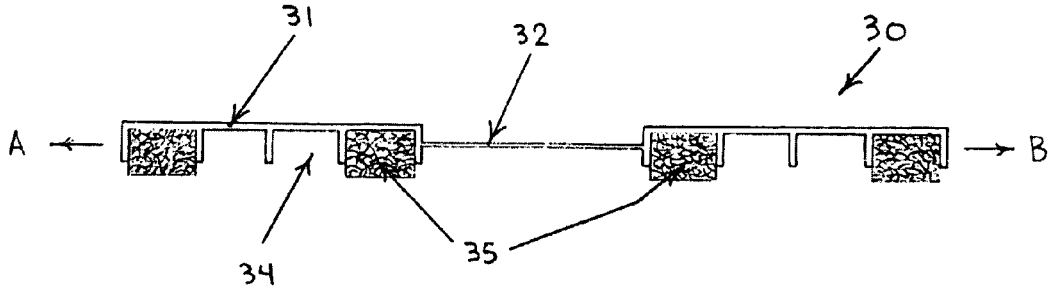
FIG. 4 is a cross-sectional view of the molded sub-floor panel illustrated in FIG. 1 along line A-B of FIG. 3.

FIG. 4 provides a cross-sectional view of a sub-floor panel 30 as shown along a line A-B in FIG. 3. The overall profile height of the sub-floor panel 30 in this illustrated system measures 3/4". A series of cavities 34 are included below upper sub-floor sections 31 on both sides of the center nailer plate 32. Resilient pads 35 are shown housed in strategic locations in sectional cavities 34. Resilient pads 35 are provided in a thickness that allows the resilient pads 35 to extend below the bottom surfaces of the sub-floor panel 30 as is illustrated to thereby allow downward deflection of the sub-floor panel 30 when loads are applied on the surface of the flooring system.

Figure 5:
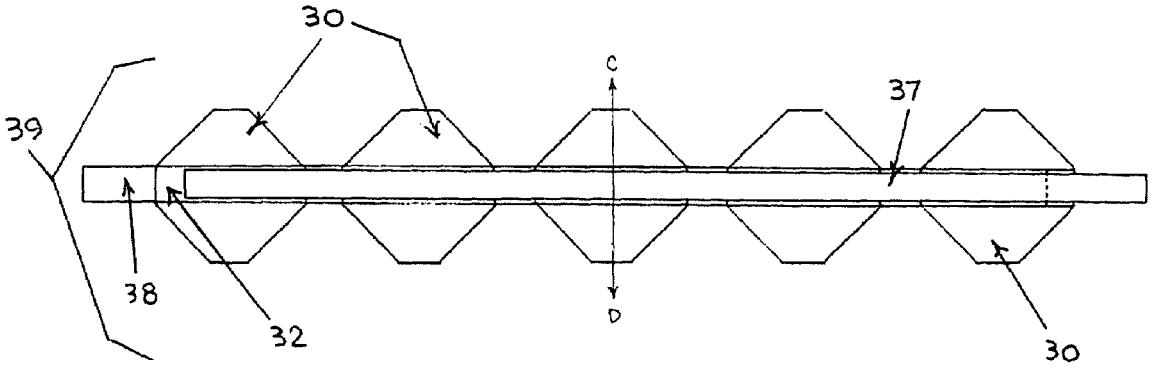
FIG. 5 is a top view of a series of the molded sub-floor panels of FIG. 1 connected with nailing strips to form an exemplary sub-floor assembly section according to the present invention.

FIG. 5 is a top view of a series of sub-floor panels 30 as held in place with an upper nailing strip 37 and lower nailing strip 38 to form a sub-floor section 39. The nailing strips 37 & 38 are preferably constructed of plywood or other suitable wood component known to soundly accept anchorage of common mechanical fasteners such as staples or cleats. In this illustrated example, nailing strips 37 & 38 are preferably 96" in length but can be set at any preferred dimension to allow desired spacing between sub-floor panels 30. Nailing strips 37 & 38 are aligned parallel with the elongated edges of the opposed channels formed by the arrangement of the center nailer plates 32 provided in the sub-floor panels 30.

Upper nailing strip 37 is preferably dimensioned narrower than lower nailing strip 38. Lower nailing strip 38 is preferably dimensioned slightly narrower than the width of the center nailer plates 32 and positioned on the underside of the sub-floor panels 30 against the bottom of the nailer plates 32. Upper nailing strip 37 is positioned on the top side of the sub-floor panels 30 against the top of the nailer plates 32.

Attachment of upper nailing strip 37 and lower nailing strip 38 thereby sandwiching the nailer plates 32 is most preferably accomplished by means of mechanical fasteners such as suitable staples and adequate adhesive.

Figure 7:
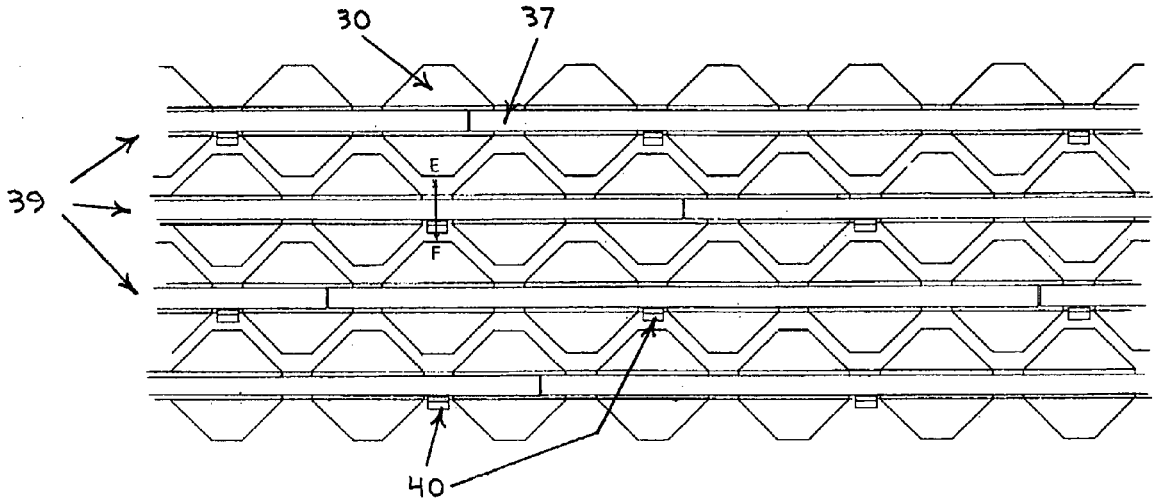
FIG. 7 is a top view of numerous sub-floor assembly sections of FIG. 5 in an exemplary arrangement for accepting a flooring surface according to the present invention.

The upper nailing strip 37 is shown to extend beyond the edge of the end sub-floor panel 30. The lower nailing strip 38 is shown to extend beyond the edge of the opposite end panel 30. In this manner, the upper nailing strip 37 used primarily in connection with one set of sub-floor panels 30 can be attached to the lower nailing strip 38 used in connection with a second, abutting set of sub-floor panels 30. For example, FIG. 7 is a top view of numerous sub-floor sections 39 and illustrates the ends of upper nailing strips 37 overlapping onto the center of an abutting sub-floor panel 30 whereby attachment of the upper nailing strips 37 to an abutting sub-floor panel 30, and its lower nailing strip 38, is preferably accomplished by means of mechanical fasteners such as staples and/or suitable adhesive.

Figure 6:
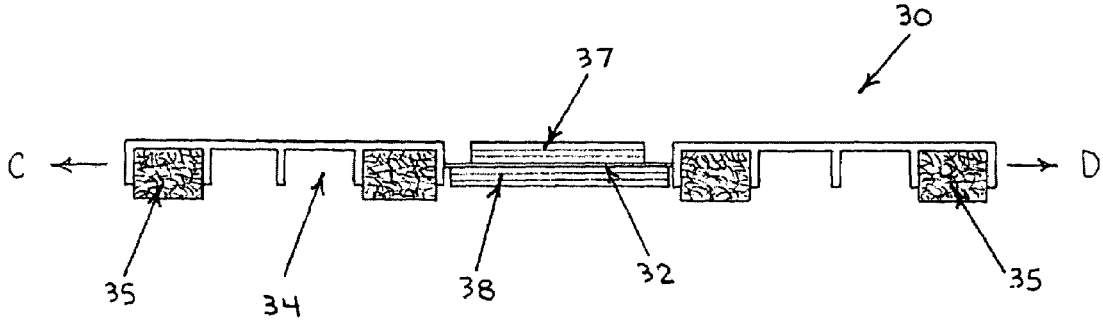
FIG. 6 is a cross-sectional view of the sub-floor assembly section along line C-D of FIG. 5.

FIG. 6 illustrates a view of the nailing strips along line C-D in FIG. 5 particularly showing the positioning of upper nailing strip 37 and lower nailing strip 38 which, when attached, sandwich center nailer plates 32 of sub-floor panels 30. Upper nailing strip 37 is preferably manufactured 1" narrower than lower nailing strip 38. Centering upper nailing strip 37 in relation to the center of lower nailing strip 38 thus forms two shoulders aligning along both elongated edges of nailing strips 37 & 38 as illustrated.

In FIG. 6 the resilient pads 35 are shown as positioned within sub-floor panel cavities 34. Resilient pads 35 are preferably held in position with pressure by sizing the width of resilient pads 35 slightly greater than the width between side walls of sub-floor cavities 34. Resilient pads 35 can also be held into position with other attachment means such as suitable adhesive. As previously noted, the profile height of resilient pads 35 is a dimension selected to extend beyond the underside surfaces of the sub-floor panel 30 and lower nailing strip 38 to allow deflection of resilient pads 35 when loads occur on the flooring system.

Figure 8:
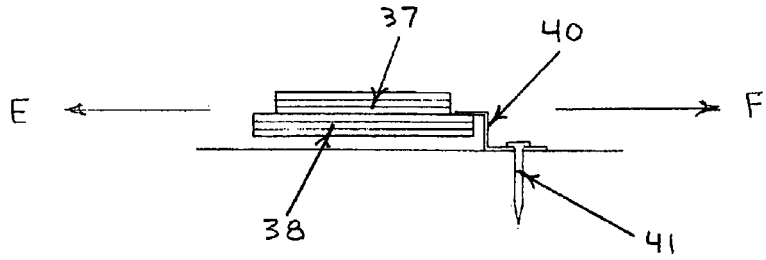
FIG. 8 is a cross-sectional view particularly illustrating the nailing strips along line E-F of FIG. 7.

Returning to FIG. 7, adjacent sub-floor section 39 rows are preferably positioned to provide uniform spacing between sub-floor panels 30 and optional anchorage clips 40 may be strategically positioned in designated locations between sub-floor panels 30. For example, FIG. 8 is an end view of nailing strips 37 & 38 and anchorage clip 40 positioned in a span between sub-floor panels as shown along line E-F in FIG. 7. Shoulder areas are shown as being formed by the top edges of lower nailing strip 38 owing to the offset side edges of upper nailing strip 37. The formation of shoulder areas on the upper edges of lower nailing strip 38 allows strategic placement of the anchorage clip 40. The anchorage clips 40 provide a means by which to integrate the sub-floor system to the supporting substrate surface, which is most typically concrete. The anchorage clip 40 includes a lower horizontal flange which rests on the substrate and allows penetration of a fastener 41, which is most commonly a steel drive pin suitable for concrete anchorage. The upper flange of the anchorage clip 40 rests soundly on the surface of the lower nailing strip 38 in a manner that adds stability to the floor system and facilitates solid contact between resilient pad components and the concrete substrate. The anchorage clip 40 is preferred to be 2" in length and manufactured of steel in an adequate thickness of 16 to 20 gauge. The profile height of the anchorage clip 40 is such that the top flange is positioned to provide slight downward pressure onto the top of the lower nailing strip 38. The anchorage clip 40 thus allows downward deflection of the flooring system against the resilient forces of the resilient pad components as surface loads are applied to the flooring while limiting upward movement of the sub-floor assembly.

Figure 9:
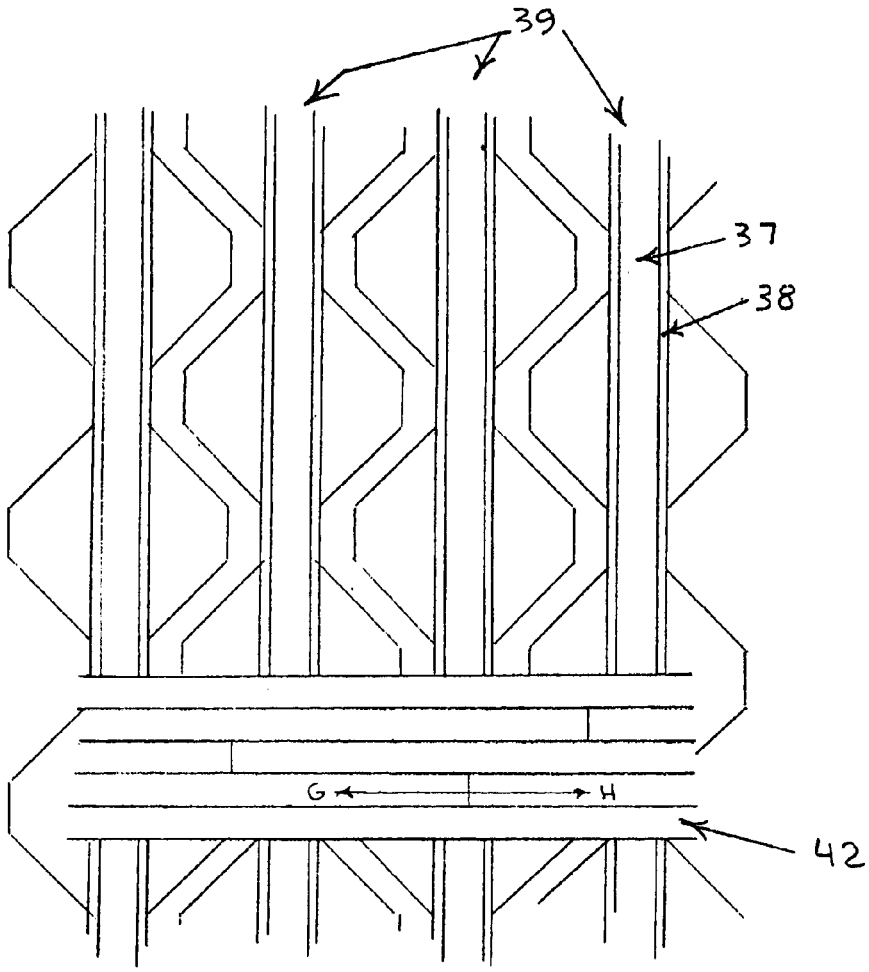
FIG. 9 is a top view of the arrangement of sub-floor assembly sections of FIG. 7 with a flooring surface attached according to the present invention.

FIG. 9 is top view of a series of sub-floor panel sections 39 with flooring surface 42 material attached. The most preferred floor surface 42 is tongue and groove wood flooring material commonly used in gymnasium sports flooring applications. Flooring surface 42 attachment is most preferably accomplished by means of mechanical fasteners such as staples or cleats driven through upper and lower nailer strips 37 & 38. The flooring surface 42 can also be soundly attached by means of applying suitable adhesive to the surfaces of the upper nailer strip 37.

Figure 10:
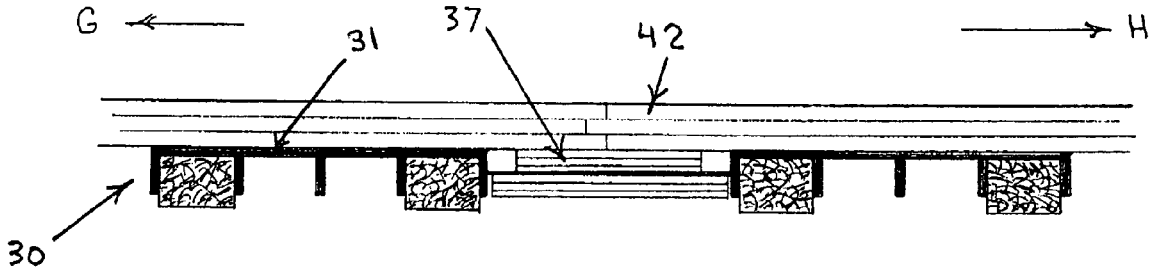
FIG. 10 is a cross-sectional view of the flooring assembly of FIG. 9 along line G-H of FIG. 9.

FIG. 10 illustrates a sub-floor panel 30 and flooring surface 42 along line G-H in FIG. 9. Flooring surface 42 is shown to rest on the upper surface 31 of the sub-floor panel 30 and upper nailing strip 37.

Figure 11:
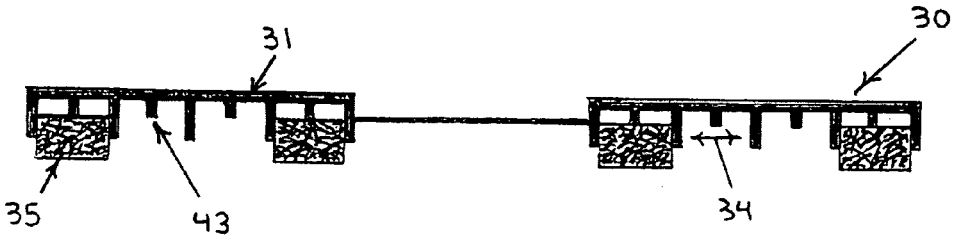
FIG. 11 is cross-sectional view of a further exemplary molded sub-floor panel along line A-B of FIG. 3.

FIG. 11 provides a cross-sectional view of a further sub-floor panel 30 underside as shown along a line A-B in FIG. 3. This detail illustrates a manner in which profile ridges 43 are provided to extend downward from the underside of the upper surface section 31. Multiple profile ridges 43 can be provided as desired in cavities 34. The dimension in width and length and number of profile ridges is implemented as related to preferred profile and performance of resilient pads 35. Incorporating profile ridges 43 allows reduced height of resilient pads 35 and also allows adjustment to desired floor system resiliency dependent on contact between the surface of the resilient pads 35 and the bottom edge or edges of profile ridges 43.

Figure 12:
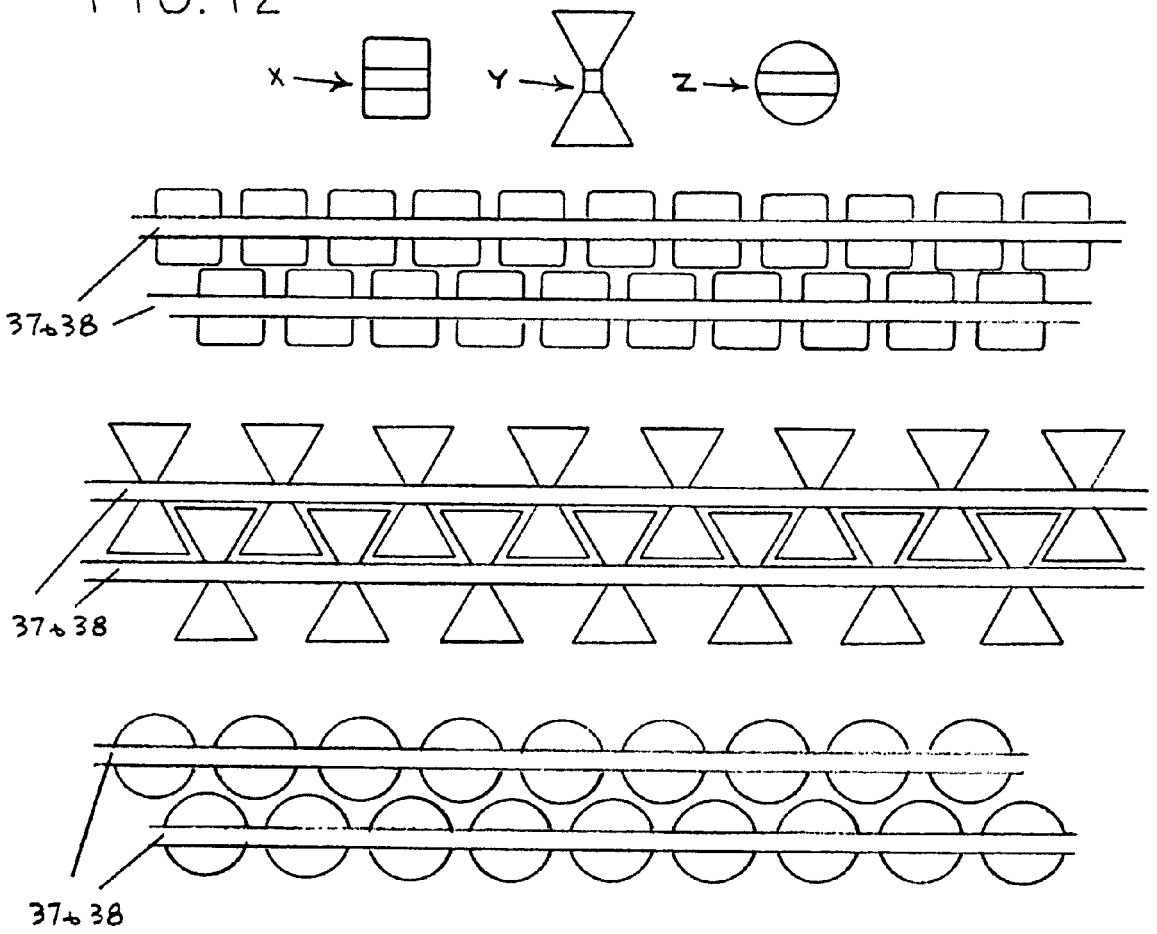
FIG. 12 illustrates top views of further exemplary sub-floor panels having various shapes according to the present invention.

FIG. 12 functions to illustrate various alternative sub-floor panel shapes x, y, & z as well as the various alternative sub-floor panels formed in arrangement with nailing strips 37 & 38 to create sub-floor sections. Alternate shapes such as illustrated in FIG. 12 or other customizing of the preferred octagonal sub-floor panel shape, shown in FIG. 1, are within the scope of the invention.

Figure 13:
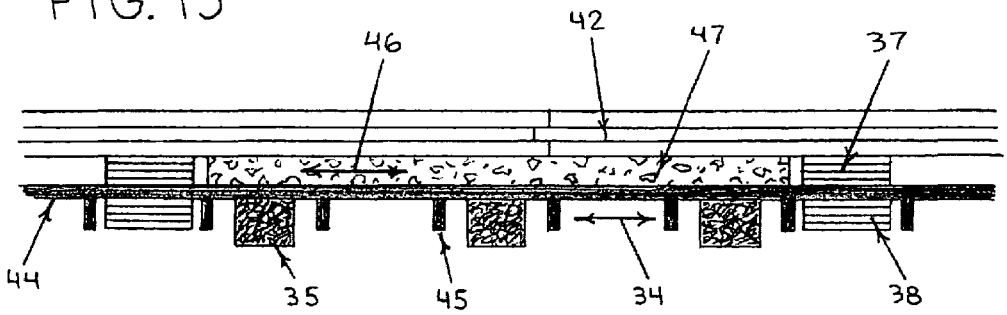
FIG. 13 is a sectional view of a further exemplary flooring system according to the present invention.
Figure 14:
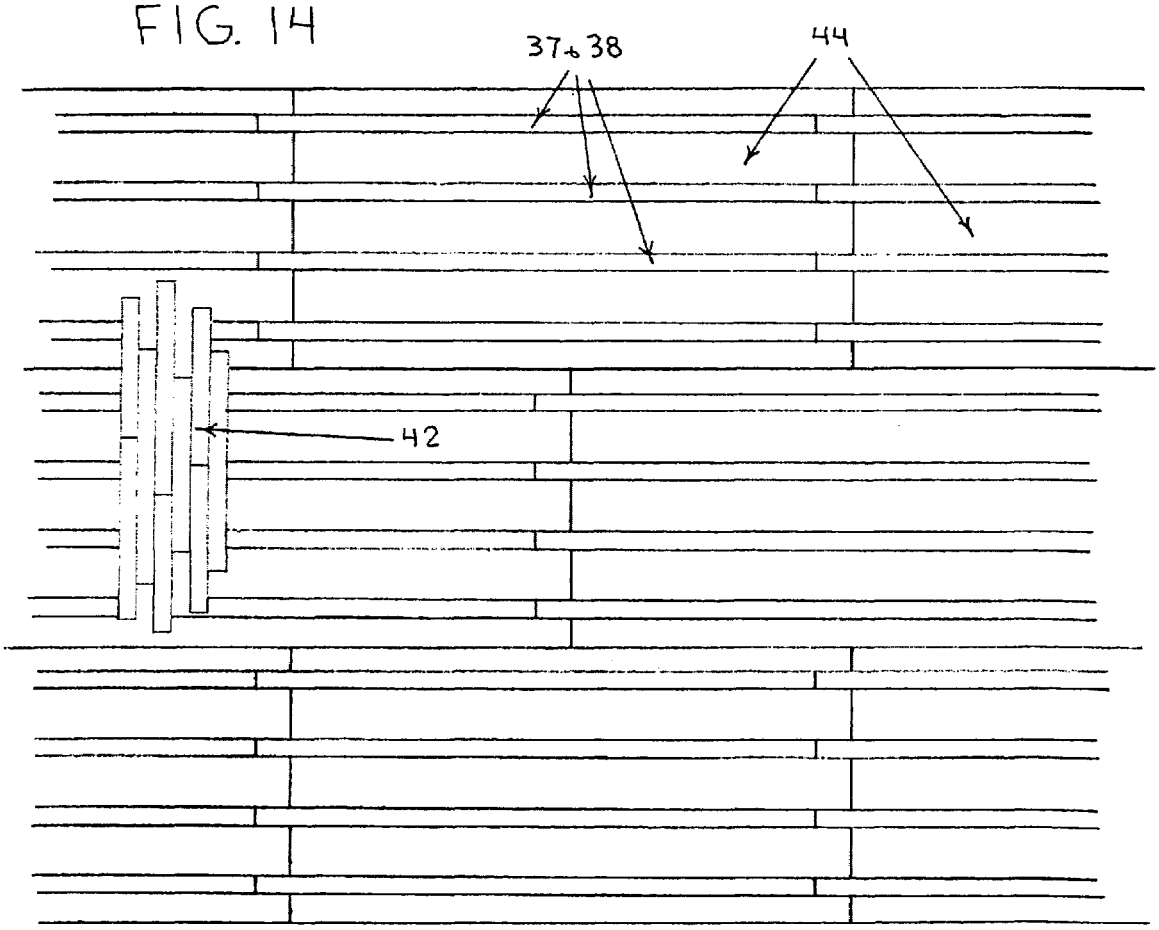
FIG. 14 is a top view of the exemplary flooring system illustrated in FIG. 13.

FIGS. 13 and 14 illustrate another exemplary flooring system in which the sub-floor is formed by combining a synthetic flat plate 44 with upper nailing strips 37 and lower nailing strips 38. The synthetic flat plate 44 is preferably manufactured through a suitable process such as molding or extrusion as known for fabrication of plastic materials. The underside of the flat plate 44 includes strategically placed resilient pads 35 manufactured from material as previously described with respect to FIG. 2. In this further exemplary system, upper nailing strip 37 and lower nailing strip 38 are most commonly attached by means of mechanical fasteners passing through both nailing strips 37 & 38 as held in position against the top and bottom of the flat plate 44 respectively. The use of adhesive between the flat plate 44 and nailers 37 & 38 is also a suitable means to provide attachment. The flat plate 44 may also include legs 45 protruding from the underside of the plate 44 to form cavities 34 for preferred positioning of resilient pads 35.

Surface voids 46 between edges of upper nailers 37 can include placement of filler material 47 to support the flooring surface 42. Filler material 47 is most preferably flexible material such as low density blanket foam.

In this further exemplary flooring system, it is to be understood that there need not be an established limit to the width or length of the flat plate 44, which can be provided in a dimension suitable to incorporate only one upper and one lower nailer 37 & 38 or in a width that allows the attachment of multiple upper and lower nailer 37 & 38 combinations as shown. Nevertheless, a preferred dimension of the flat plate 44 is 48" in width and 96" in length when incorporating multiple nailers 37 & 38. A thickness of the flat plate 44 is preferably ⅛" but can be provided in any thickness determined as a dimension most suitable for desired support and flexibility related to activities on the floor. The flooring surface 42 is most typically attached to nailing strips 37 & 38 by means of mechanical fasteners such as staples or cleats. As seen in FIG. 14, the upper nailing strips 37 preferably have one end which extends (e.g., 6") beyond the end of the synthetic flat plate 44 with the opposite end resting (e.g., 6") short of the end edge of the synthetic flat plate 44. The offset alignment allows overlapping of end joints of upper nailing strips 37 onto synthetic flat plates 44, and nailing strips 38. The distance by which the ends extend can be adjusted as desired for preferred integration.

It is also to be appreciated that, while the flat plate 44 is preferably manufactured as a solid panel, the flat plate 44 can be manufactured with ridges or interior air chambers and remain within the intended scope of the invention.

When the dimension of the flat plate 44 is established as being 48" in width by 96" in length the flat plate 44 may have attached thereto, for example, four upper and four lower sleeper strips 37 & 38. In such a case, the preferred dimension of the sleeper strips 37 & 38 is 3" in width and 96" in length spaced 12" on center opposite to the direction of the finished floor surface 42. As noted above, sizing of the flat plate 44 is practically unlimited and can be adjusted to narrow widths to incorporate, for example, only a single upper and lower nailing strip 37 & 38 and, as such, there is no set limit to the number of nailing strip rows 37 & 38 that need be attached to each flat plate 44. Rather, the number of nailing strip rows 37 & 38 as well as width dimension and spacing of nailing strips 37 & 38 is most typically dependent on desired support of the flooring surface 42. In FIG. 14, a preferred arrangement of multiple flat plates 44 is shown wherein the multiple flat plates 44 are placed into a formation by offsetting end joints in alternate rows to create a staggered brick pattern.

Figure 15:
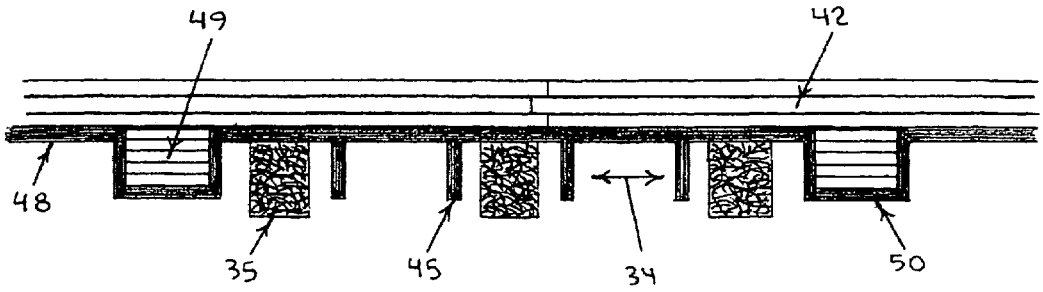
FIG. 15 is a sectional view of a still further exemplary flooring system according to the present invention.
Figure 16:
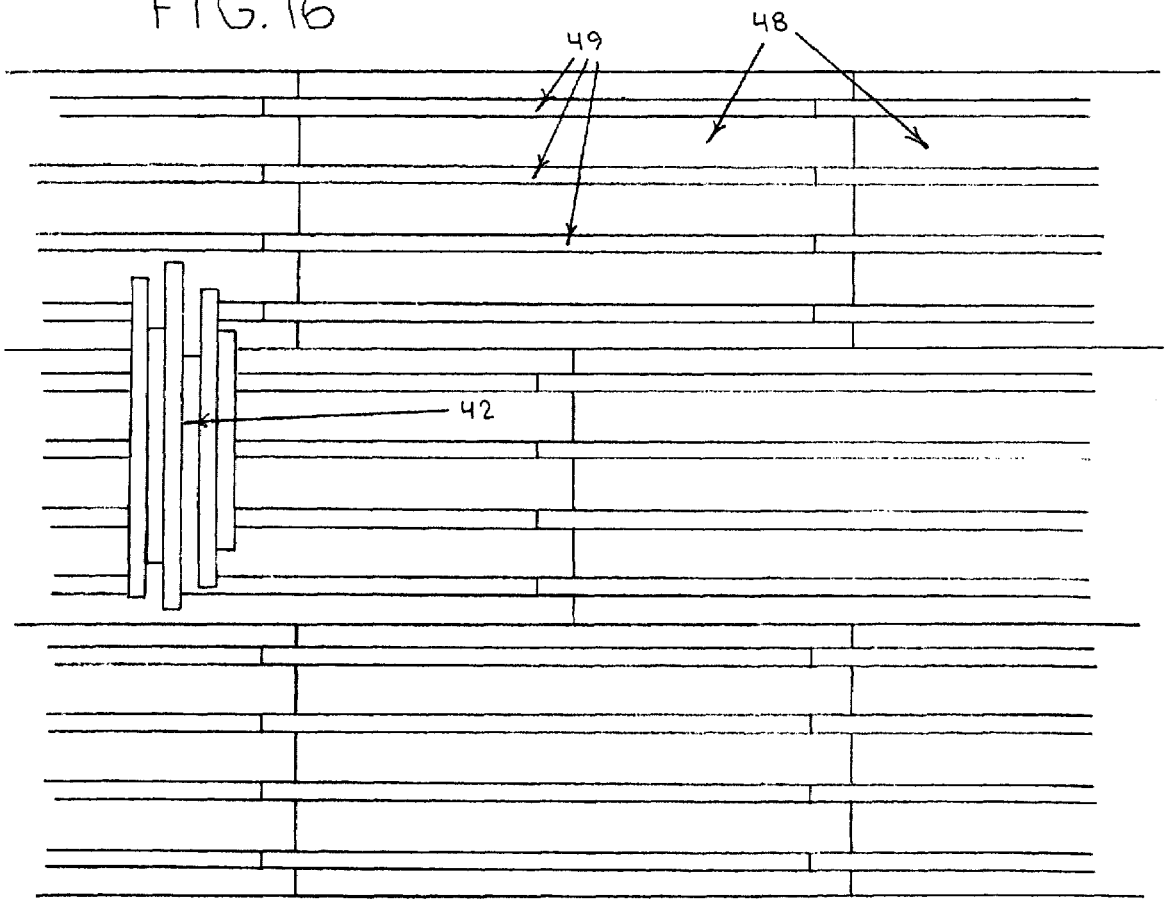
FIG. 16 is a top view of the flooring system illustrated in FIG. 15.

FIGS. 15 and 16 illustrate a further exemplary flooring system in which the sub-floor is formed by combining a channeled or slotted plate 48 and nailing strips 49. The slotted plate 48 is preferably manufactured through a process in which plastics are commonly fabricated by suitable means such as molding or extrusion to produce a panel including channels or depressed slots 50. The depressed slots 50 are arranged to typically align parallel to the long dimension of the slotted plate 48. Within such a system the underside of the slotted plate 48 would again include strategically placed resilient pads 35 manufactured from material as previously described with respect to FIG. 2. In this regard, the slotted plate 48 may include legs 45 protruding from the underside of the slotted plate 48 to form cavities 34 for preferred positioning of resilient pads 35 or added support for the surface of the slotted plate 48. Furthermore, within such a system the nailing strips 49 are preferably attached by means of mechanical fasteners passing through from the underside of the slotted plate 48. The use of adhesive between the slotted plate 48 and nailing strips 49 is also a suitable means to provide attachment. Nailing strips 49 are preferably dimensioned in a thickness to allow a generally flush alignment between the surface of the nailing strips 49 and adjacent surface of the slotted plate 48 to allow even support of the underside of the finished flooring surface 42. The flooring surface 42 is typically attached to nailing strips 49 by means of mechanical fasteners such as staples or cleats.

As before, with respect to this illustrated flooring system example, there need not be an established limit to the width or length of the slotted plate 48, which can be provided in a dimension suitable to incorporate only one nailer strip 49 or in a width that allows the attachment of multiple nailer strips 49 such as shown in FIG. 15. In this illustrated example, a dimension of the slotted plate 48 is 48" in width and 96" in length with the depressed slots 50 measuring approximately 1" deep and 3" in width. Nailer strips 49 could then be 3" in width, 96" in length, and 1" thick, manufactured of plywood or suitable dimensioned lumber. Again, the nailing strips 49 would preferably have an end extending (e.g., 6") beyond the end of the slotted plates 48 with the opposite end resting (e.g., 6") short of the end edge of the slotted plate 48 with the offset alignment allowing for overlapping of extending end joints of nailing strips 49 onto slotted plates 48, which are preferably fastened together with adhesive or suitable mechanical fasteners such as common staples. As with all illustrated and described embodiments, the depth and width dimensions, in this case of depressed slots 50 and related nailer strips 49, can be adjusted as desired for suitable performance. As illustrated in FIG. 16, slotted plates 48 may again be arranged by offsetting end joints in alternate rows to create a staggered brick pattern.

Figure 17:
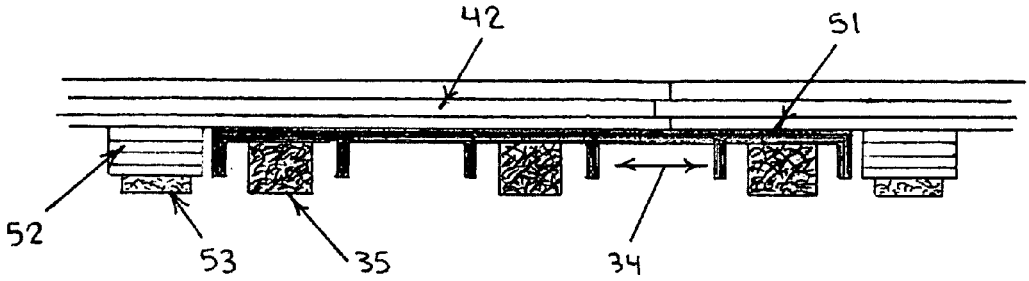
FIG. 17 is a sectional view of a still further exemplary flooring system according to the present invention.
Figure 18:
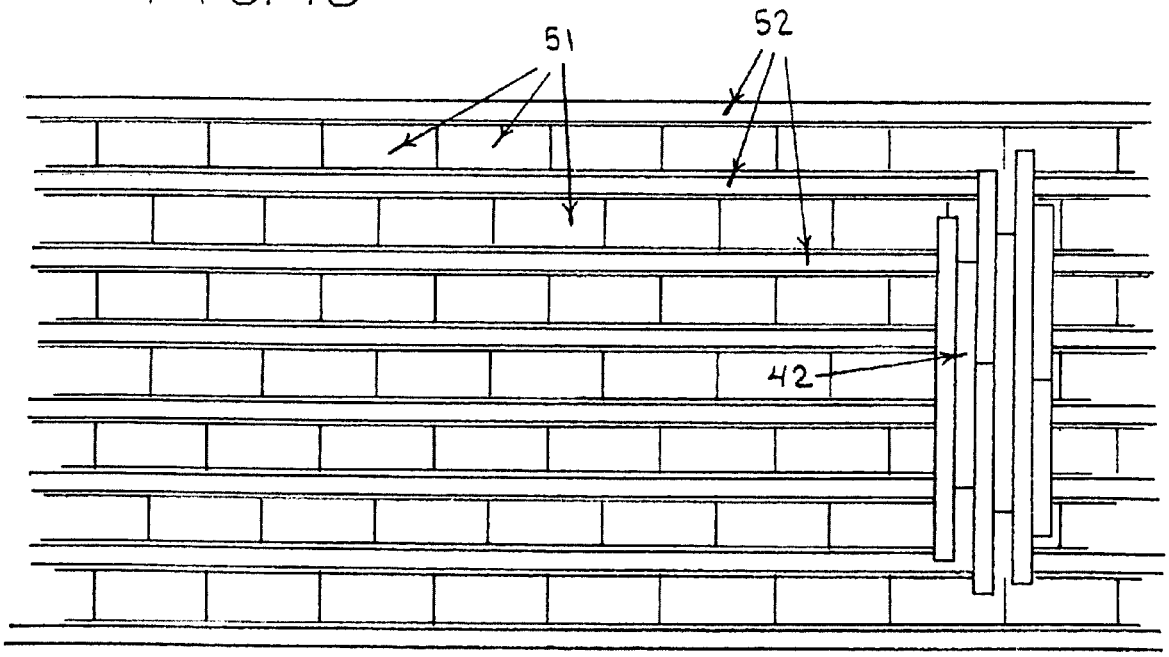
FIG. 18 is a top view of the flooring system illustrated in FIG. 17.

Turning now to FIGS. 17 and 18 there is illustrated a further exemplary flooring system in which the sub-floor is formed by combining support panels 51 and suspended nailer strips 52. Support panels 51 are preferably manufactured through a process in which plastics are commonly fabricated by suitable means such as molding or extrusion. Support panels 51 most desirably include cavities 34 formed as described in detail with respect to FIG. 2, but can also be provided as a flat plate profile. The underside of support panels 51 are shown as including strategically placed resilient pads 35 manufactured from material as previously described with respect to FIG. 2. In this further illustrated example, suspended nailing strips 52 include a form of resiliency such as foam blocks 53 or other suitable resilient pads as previously described. The upper surface of support panels 51 and suspended nailing strips 52 are arranged in a flush manner to allow even support against the underside of the finished floor surface 42.

As shown in FIG. 18 the synthetic support panels 51 would be preferably arranged in a parallel manner along side edges of suspended nailer strips 52. In the example illustrated, the support panels 51 would measure 9" in width and 18" in length, but are not limited to this size but rather to any suitable dimension that provides desired support and practical manufacturing. The suspended nailer strips 52 in the example illustrated measure 3" in width and 96" in length and can be sized in any suitable dimension that provides an adequate surface for attachment of the finished flooring surface 42. With this illustrated arrangement, the support panels 51 are preferably spaced between abutting end joints by ¼" but can be spaced at other suitable dimensions according to desired support and resiliency. Support panels 51 may also include some form to interlock or overlap end joints.

Figure 19:
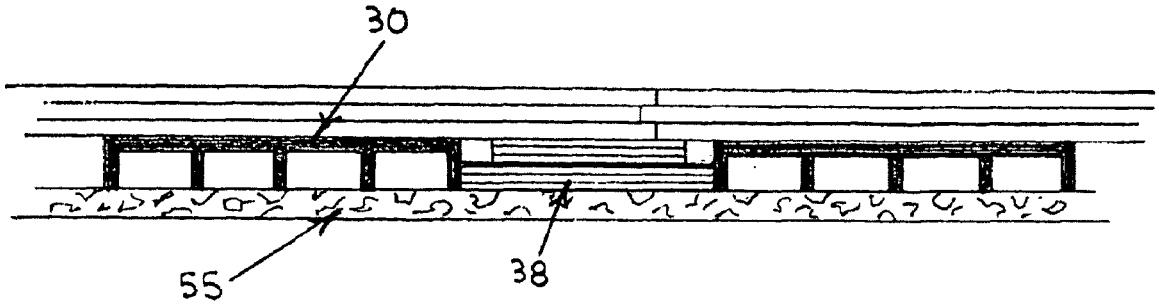
FIG. 19 is a sectional view illustrating a yet further exemplary arrangement using an additional resilient component according to the present invention.

In FIG. 19 there is illustrated an alternate manner to introduce resiliency into the flooring system. To this end, a cushion blanket 55 may be placed below sub-floor panels 30 and lower nailer strips 38 to provide a manner of resiliency to the floor system. A cushion blanket 55 most commonly consists of material such as open cell flexible foam, or other such products that provide desired resilience and support.

Figure 20:
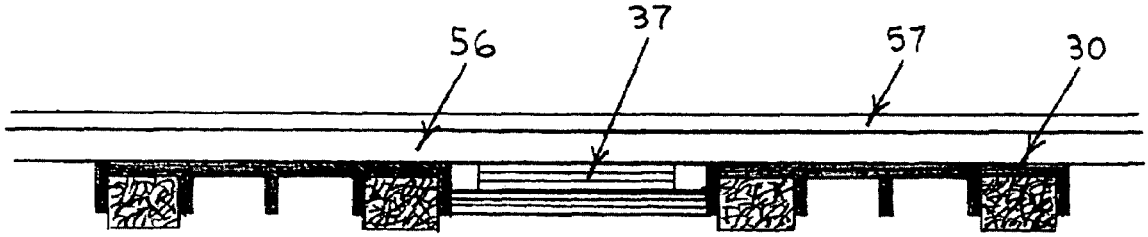
FIG. 20 is a sectional view of a yet further exemplary arrangement using an additional flooring supporting component according to the present invention.

In FIG. 20 there is illustrated an alternate manner to introduce a sub base 56 on top of sub-floor panels 30 and nailer strips 37. The inclusion of a sub base 56 may be preferred for added support or allowance of floor surface materials such as rubber sheet goods or poured urethanes 57 which require continuous monolithic surfaces below.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalents thereof.

What is claimed is:

1. A sub-floor assembly for supporting a sports flooring, comprising:

a sub-floor panel component formed of a plastic material having an upwardly facing channel and an opposed downwardly facing channel thereby providing a surface intermediate to the upwardly facing channel and the downwardly facing channel;

a resilient material on which is carried the sub-floor panel component;

a first strip of anchoring material disposed within the upwardly facing channel; and a second strip of anchoring material disposed within the downwardly facing channel;

wherein the first strip of anchoring material is attached to the second strip of anchoring material thereby sandwiching the surface between the first strip of anchoring material and the second strip of anchoring material with the attached anchoring materials providing a means by which the sports flooring is attachable to the sub-floor panel component.

2. The sub-floor assembly as recited in claim 1, wherein the first strip of anchoring material and the second strip of anchoring material each comprise a wood product.

3. The sub-floor assembly as recited in claim 1, comprising a mechanical fastener used to attach the first strip of anchoring material to the second strip of anchoring material.

4. The sub-floor assembly as recited in claim 1, wherein the surface has at least one opening and an adhesive is used to attach the first strip of anchoring material to the strip of anchoring material via the opening.

5. The sub-floor assembly as recited in claim 1, wherein the resilient material is attached to an underside of the sub-floor panel component.

6. The sub-floor assembly as recited in claim 1, wherein the resilient material is disposed in a channel formed in the underside of the sub-floor panel component.

7. The sub-floor assembly as recited in claim 6, wherein the channel formed in the underside of the sub-floor panel component in which the resilient material is disposed has an upper surface from which downwardly extends a ridge which engages a top surface of the resilient material.

8. The sub-floor assembly as recited in claim 1, comprising an anchor cooperable with the second strip of anchoring material to allow for downward movement of the sub-floor assembly against a resilient force of the resilient material while limiting upward movement of the sub-floor assembly.

9. The sub-floor assembly as recited in claim 8, wherein the first strip of anchoring material and the second strip of anchoring material are arranged to form an upwardly facing shoulder and the anchor engages the shoulder.

10. The sub-floor assembly as recited in claim 1, wherein the sub-floor panel component has an octagon shape.

11. A sports flooring system, comprising:

a plurality of sub-floor panel components each formed of a plastic material and each having a formed channel wherein the formed channels of the plurality of sub-floor panel components are linearly aligned;

a resilient material on which is carried each of the plurality of sub-floor panel components;

a first strip of anchoring material disposed within the linearly aligned formed channels of the plurality of sub-floor panel components; and a plurality of flooring surface strips attached to the first strip of anchoring material.

12. The sports flooring system as recited in claim 11, wherein the formed channel of each of the plurality of sub-floor panel components is downwardly facing.

13. The sports flooring system as recited in claim 12, comprising a second strip of anchoring material aligned over the first strip of anchoring material with each of the plurality of sub-floor panel components having a portion that is disposed intermediate the first strip of anchoring material and the second strip of anchoring material with the plurality of flooring surface strips being thereby also attached to the second strip of anchoring material.

14. The sports flooring system as recited in claim 13, wherein the second strip of anchoring material is carried upon an upper surface of each of the plurality of sub-floor panel components thereby providing a spacing between the upper surface of each of the plurality of sub-floor panel components and the underside of the plurality of flooring surface strips.

15. The sports flooring system as recited in claim 14, comprising a filling material positioned within the spacing.

16. The sports flooring system as recited in claim 12, wherein each of the plurality of sub-floor panel components comprises an upwardly facing channel disposed opposite the downwardly facing channel thereby providing a surface between the upwardly facing channel and the downwardly facing channel and comprises a second strip of anchoring material disposed within the upwardly facing channel of each of the plurality of sub-floor panel components wherein the first strip of anchoring material is attached to the second strip of anchoring material thereby sandwiching the surface of each of the sub-floor panel components between the first strip of anchoring material and the second strip of anchoring material with the plurality of flooring surface strips being thereby also attached to the second strip of anchoring material.

17. The sports flooring system as recited in claim 16, wherein an upper surface of the second strip of anchoring material is at least level with an upper surface of each of the sub-floor panel components.

18. The sports flooring assembly as recited in claim 16, wherein the first strip of anchoring material and the second strip of anchoring material each comprise a wood product.

19. The sports flooring assembly as recited in claim 16, comprising a mechanical fastener used to attach the first strip of anchoring material to the second strip of anchoring material.

20. The sports flooring assembly as recited in claim 16, wherein the surface of at least one of the plurality of sub-floor panel components has at least one opening and an adhesive is used to attach the first strip of anchoring material to the second strip of anchoring material via the at least one opening.

21. The sports flooring assembly as recited in claim 11, wherein the resilient material is attached to an underside of each of the plurality of sub-floor panel components.

22. The sports flooring assembly as recited in claim 11, wherein the resilient material is disposed in a channel formed in the underside of each of the plurality of sub-floor panel components.

23. The sports flooring assembly as recited in claim 22, wherein the channel formed in the underside of each of the plurality of sub-floor panel components in which the resilient material is disposed has an upper surface from which downwardly extends a ridge which engages a top surface of the resilient material.

24. The sports flooring assembly as recited in claim 11, comprising an anchor cooperable with the first strip of anchoring material to allow for downward movement of the sports flooring assembly against a resilient force of the resilient material while limiting upward movement of the sports flooring assembly.

25. The sports flooring assembly as recited in claim 11, wherein the first strip of anchoring material and the second strip of anchoring material are arranged to form an upwardly facing shoulder and the anchor engages the shoulder.

26. The sports flooring assembly as recited in claim 11, wherein each of the plurality of sub-floor panel components has an octagon shape.

27. A sports flooring system, comprising:

a plurality of linearly arranged sub-floor panel components each formed of a plastic material;

a resilient material disposed under each of the plurality of sub-floor panel components;

a first strip of anchoring material disposed adjacent to a first side of the linearly arranged sub-floor panel components;

a second strip of anchoring material disposed adjacent to a second side of the linearly arranged plurality of sub-floor panel components opposite the first side; and a plurality of flooring surface strips attached to the first strip of anchoring material and the second strip of anchoring material and supported by the plurality of sub-floor panel components.

28. The flooring system as recited in claim 27, comprising a resilient material disposed under each of the first and second strips of anchoring material.

29. The flooring system as recited in claim 27, wherein each of the plurality of sub-floor panel components has an underside in which is formed a plurality of channels having intermediate ridges.

30. The flooring system as recited in claim 29, wherein the resilient material is carried within one or more of the plurality of channels between intermediate ridges.

* * * * *